US011167828B2

(12) United States Patent
Borel et al.

(10) Patent No.: US 11,167,828 B2
(45) Date of Patent: Nov. 9, 2021

(54) METHOD FOR CONTROLLING THE BUOYANCY OF A SUBMARINE VEHICLE

(71) Applicant: THALES, Courbevoie (FR)

(72) Inventors: Christophe Borel, Sophia-Antipolis (FR); Eric Rouvier, Sophia-Antipolis (FR); Cyril Bouyer, Sophia-Antipolis (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/762,133

(22) PCT Filed: Nov. 29, 2018

(86) PCT No.: PCT/EP2018/083006
§ 371 (c)(1),
(2) Date: May 6, 2020

(87) PCT Pub. No.: WO2019/120926
PCT Pub. Date: Jun. 27, 2019

(65) Prior Publication Data

US 2020/0361583 A1 Nov. 19, 2020

(30) Foreign Application Priority Data

Dec. 19, 2017 (FR) ..... 1701321

(51) Int. Cl.
*B63G 8/22* (2006.01)
*B63G 8/00* (2006.01)

(52) U.S. Cl.
CPC ..... *B63G 8/22* (2013.01); *B63G 8/001* (2013.01); *B63G 2008/004* (2013.01)

(58) Field of Classification Search
CPC . B63G 8/00; B63G 8/001; B63G 8/08; B63G 8/14; B63G 8/18; B63G 8/22; B63G 8/24; B63G 8/38; B63G 2008/004
(Continued)

(56) References Cited

U.S. PATENT DOCUMENTS 3,157,145 A * 11/1964 Farris ..... B63G 8/24 114/333
3,952,349 A * 4/1976 Erath ..... B63G 8/14 114/333
(Continued)

FOREIGN PATENT DOCUMENTS

GB 2335888 A 10/1999
JP 10-86894 A 4/1998

*Primary Examiner* — Lars A Olson
(74) *Attorney, Agent, or Firm* — BakerHostetler

(57) ABSTRACT

A method for regulating the buoyancy of an underwater vehicle in such a way that it substantially exhibits a predetermined target buoyancy Fc when it is immersed in a volume of liquid delimited by a first surface and a second surface, along a vertical axis, the method includes starting from an initial buoyancy of the vehicle that keeps the vehicle at the level of the first surface, a first step of modifying the density of the vehicle so that it moves closer to the second surface, the first step being implemented as far as a second step of detecting the crossing, by the vehicle, of a predetermined non-zero threshold on distance with respect to the first surface, along the vertical axis, then a third step of modifying the density of the vehicle until the vehicle exhibits substantially the target buoyancy.

9 Claims, 4 Drawing Sheets

(58) Field of Classification Search
USPC ..... 114/312, 333
See application file for complete search history.

(56) References Cited

U.S. PATENT DOCUMENTS

| | | | | |
|---|---|---|---|---|
| 4,266,500 | A | 5/1981 | Jurca | |
| 8,418,642 | B2 * | 4/2013 | Vosburgh | B63G 8/22 114/312 |
| 2007/0125289 | A1 | 6/2007 | Asfar et al. | |
| 2016/0107735 | A1 | 4/2016 | Nasuno | |

* cited by examiner

METHOD FOR CONTROLLING THE BUOYANCY OF A SUBMARINE VEHICLE

CROSS-REFERENCE TO RELATED APPLICATIONS

This application is a National Stage of International patent application PCT/EP2018/083006, filed on Nov. 29, 2018, which claims priority to foreign French patent application No. FR 1701321, filed on Dec. 19, 2017, the disclosures of which are incorporated by reference in their entirety.

FIELD OF THE INVENTION

The field of the invention is that of underwater vehicles. These vehicles are able to exhibit negative buoyancy, namely are able to be fully immersed. It relates more particularly to unmanned underwater vehicles, also referred to as UUVs from the English expression "Unmanned Underwater Vehicles", which may be autonomous vehicles also referred to as AUVs with reference to the English expression ("Autonomous Underwater Vehicle") or non-autonomous vehicles also referred to as ROVs with reference to the English expression "remotely operated vehicle" or vehicles commonly referred to as fish when they are not provided with propulsion means.

BACKGROUND

The buoyancy is the force acting on the underwater vehicle is the resultant of the difference between the upthrust and the weight of the device. This force may be directed upward (positive buoyancy, weight less than the upthrust) or downward (negative buoyancy, weight greater than the upthrust).

An underwater vehicle conventionally needs to exhibit positive buoyancy on launch. Thus, the vehicle will naturally return to float on the surface of the water when it is subjected to the upthrust and to its weight alone. That allows it to be recovered from a surface platform when the vehicle no longer has energy for its propulsion. That also allows the underwater vehicle to communicate with a surface platform via radioelectric communication means belonging to the underwater vehicle which are then out of the water. That also allows the underwater vehicle to be supplied with energy from a surface platform without it consuming energy for its propulsion. Once the underwater vehicle is launched, it is conventionally intended to carry out underwater, for example inspection, missions, which means that it is called upon to dive, using a propulsion means, in order to reach positions of great depth before (re)surfacing, for example in order to top up on energy, to communicate with a significant transmission rate, to be recovered from a surface platform.

Now, in order to be able to dive under the water in order to carry out its mission and to maintain its submerged position, the underwater vehicle, which exhibits a positive buoyancy, needs to overcome forces which are all the greater the greater its buoyancy. It may therefore find itself unable to dive under the water or having to consume, in order to dive, energy that is all the greater the greater its buoyancy, and which has the effect of limiting its endurance and the duration of its mission. When its positive buoyancy is too high, the vehicle may also have difficulty diving because of disturbances generated by the sea state on the surface which partially and randomly uncovers the actuators of the device, such as its propulsion means, which become ineffective when out of the water. The ability to adjust the buoyancy of the vehicle (or to balance it by adjusting its buoyancy) is therefore of key importance and this step needs to be performed with very great precision.

Underwater vehicles may also be balanced with a negative buoyancy on launch. That makes it possible to achieve a configuration in which the underwater vehicle will naturally settle on the bottom of the sea and thus be invisible from the surface. During its mission, the underwater vehicle will need to resurface intermittently or ascend toward the surface. Now, in order to resurface, the underwater vehicle which has a negative buoyancy needs to overcome forces that are all the greater the lower its negative buoyancy, namely the higher its absolute value. It may thus find itself unable to resurface or having to consume, in order to resurface, energy that is all the greater the lower its negative buoyancy, and that has the effect of limiting its autonomy and the duration of its mission.

It is therefore apparent that, in order to carry out its mission optimally, the underwater vehicle needs to be able to regulate its buoyancy according to the steps of the mission: positive buoyancy on launch, neutral buoyancy during the dive phases and negative buoyancy in order to achieve stealth.

One solution for regulating the buoyancy of the underwater vehicles is to perform a static weighing prior to launch so as to substantially balance the weight and the upthrust. Deficiencies with this solution are that this regulation is fixed for the duration of the mission (the buoyancy cannot be controlled) and that this regulation is not robust in respect of local variations in water density (a vehicle initially weighed to be slightly buoyant in sea water may begin to sink on arriving in fresh water), or in respect of variations in the mass of the underwater vehicle, for example if shellfish or algae attach to its hull, or to variations in the volume of the body of the vehicle, for example as a result of compression of the hull under the effect of the pressure.

Another solution is to equip the underwater vehicle with means for varying its density of the underwater vehicle. One method for regulating the buoyancy of an underwater vehicle upon launch conventionally consists in manually operating the means for varying the density. The vehicle initially has positive buoyancy which is not known precisely, an operator operates the means to vary the density in order to increase the density of the underwater vehicle slowly so that its buoyancy continually decreases to the point at which the vehicle reaches a target lower positive buoyancy. This solution is lengthy, tricky and difficult to automate. For example, a small variation in the mass of the underwater vehicle may vary the buoyancy of the underwater vehicle significantly, so adjusting the buoyancy of the underwater vehicle needs to be performed with great precision and very slowly in order to prevent the underwater vehicle from sinking as this could prevent the operator from recovering the vehicle.

SUMMARY OF THE INVENTION

One object of the invention is to limit at least one of the above disadvantages.

To this end, one subject of the invention is a method for regulating the buoyancy of an underwater vehicle in such a way that it exhibits substantially a predetermined target buoyancy when it is immersed in a volume of liquid delimited, along a vertical axis, by a first surface and a second surface, the method comprising:

starting from an initial buoyancy of the vehicle that keeps the vehicle at the level of the first surface, a first step of modifying the density of the vehicle so that it moves closer to the second surface, the first step being implemented as far as a second step of detecting the crossing, by the vehicle, of a predetermined non-zero threshold on distance with respect to the first surface, along the vertical axis, then a third step of modifying the density of the vehicle until the vehicle exhibits substantially the target buoyancy.

Advantageously, the variation in density of the vehicle during the third step is predetermined.

Advantageously, the first step is implemented in such a way that the vehicle exhibits a predetermined buoyancy upon the detection of the crossing of the threshold.

Advantageously, the target buoyancy has the same sign as the initial buoyancy and an absolute value lower than the absolute value of the initial buoyancy.

Advantageously, during the implementation of the method, the vehicle moves, along the vertical axis, only under the effect of a variation in its buoyancy.

Advantageously, the first surface is the surface of the liquid, namely the upper surface thereof, and the initial buoyancy is positive, the first step of modifying the density being a step of increasing the density of the vehicle, the distance threshold being an immersion threshold.

Advantageously, the first surface is a bottom of the volume of liquid, the initial buoyancy is negative, the first step of modifying the density being a step of reducing the density, the distance threshold being a threshold on altitude with respect to the first surface.

Advantageously, during the first step and during the third step, the mass of the vehicle is varied for a constant volume of the underwater vehicle, and/or the volume of the marine vehicle is varied for a constant mass for a constant mass of the underwater vehicle.

Advantageously, the vehicle comprises a first variable-density reservoir, the variation in density of which causes the density of the vehicle to vary, this being positioned near a first longitudinal end of the vehicle, and a second variable-density reservoir the variation in density of which causes the density of the vehicle to vary and which is positioned near a second longitudinal end of the vehicle, wherein, during the first step, the density of a predetermined single one, of the first reservoir and the second reservoir, is varied.

Advantageously, the invention also relates to a balancing method comprising the method for regulating the buoyancy followed by the method for regulating the buoyancy according to the invention and a step of regulating the longitudinal pitch of the vehicle.

The invention also relates to a device for regulating the buoyancy making it possible to regulate the buoyancy of the underwater vehicle and comprising means for varying the density of the underwater vehicle and at least one sensor making it possible to detect the crossing, by the vehicle, of a predetermined non-zero threshold on distance with respect to a first surface delimiting, in a vertical direction, the volume of a liquid in which the vehicle is immersed, the buoyancy regulating device being configured to implement a method comprising the following steps when a buoyancy regulating condition is satisfied:

starting from an initial buoyancy that keeps the vehicle at the level of the first surface; a first step of modifying the density of the vehicle via the buoyancy varying means so that the vehicle moves closer to a second surface likewise delimiting the volume of liquid in the vertical direction, the first step being implemented as far as a second step of detecting, via the sensor, the crossing by the vehicle of the distance threshold, then a third step of modifying the density of the vehicle, using the buoyancy varying means, until the vehicle exhibits substantially the target buoyancy.

Advantageously, the first step is implemented in such a way that the vehicle has a predetermined buoyancy upon the detection of the crossing of the threshold.

Advantageously, the variation in density during the third step is predetermined.

Advantageously, the target buoyancy has the same sign as the initial buoyancy and an absolute value lower than the absolute value of the initial buoyancy.

The invention also relates to a vehicle comprising the device for varying for regulating the buoyancy according to the invention.

BRIEF DESCRIPTION OF THE DRAWINGS

The invention will be better understood from studying a number of embodiments described by way of entirely non-limiting examples and illustrated by attached figures in which.

From one figure to another, the same elements are denoted by the same numerical references.

DETAILED DESCRIPTION

In the present patent application, the vertical and horizontal directions are defined in a terrestrial frame of reference. Upper and lower positions being determined along a vertical axis z of the terrestrial frame of reference.

The invention relates to a method for regulating the buoyancy of the underwater vehicle 1 in such a way that it exhibits a final buoyancy substantially equal to a target buoyancy.

The underwater vehicle 1 initially exhibits a buoyancy, referred to as initial, such that it keeps the underwater vehicle 1 at the level of a surface S, referred to as initial, delimiting the volume of liquid in which the underwater vehicle is immersed, for example water E, for example seawater or fresh water, in a vertical direction (defined in a terrestrial frame of reference). The vehicle 1 is kept at the level of the initial surface S by its buoyancy alone.

This initial surface is, for example, the upper surface of the volume of liquid, for example the surface of the water S. The initial buoyancy of the underwater vehicle 1 is then positive and the underwater vehicle initially floats on the surface of the water.

The volume of liquid in which the underwater vehicle is immersed is delimited, in the vertical direction z, by two surfaces distant from one another in the vertical direction, one of these being the upper surface and one a lower surface. In the case of a vehicle immersed in seawater, this volume is delimited by the surface of the water S (upper surface) and by the seabed Fd (lower surface).

As an alternative, the initial surface may be the lower surface of the volume of the liquid, namely the bottom of the volume of liquid, for example the seabed. The initial buoyancy of the vehicle is then negative and the vehicle is initially set down on the lower surface of the volume of the liquid, namely on the bottom or the seabed.

Figure 1A:
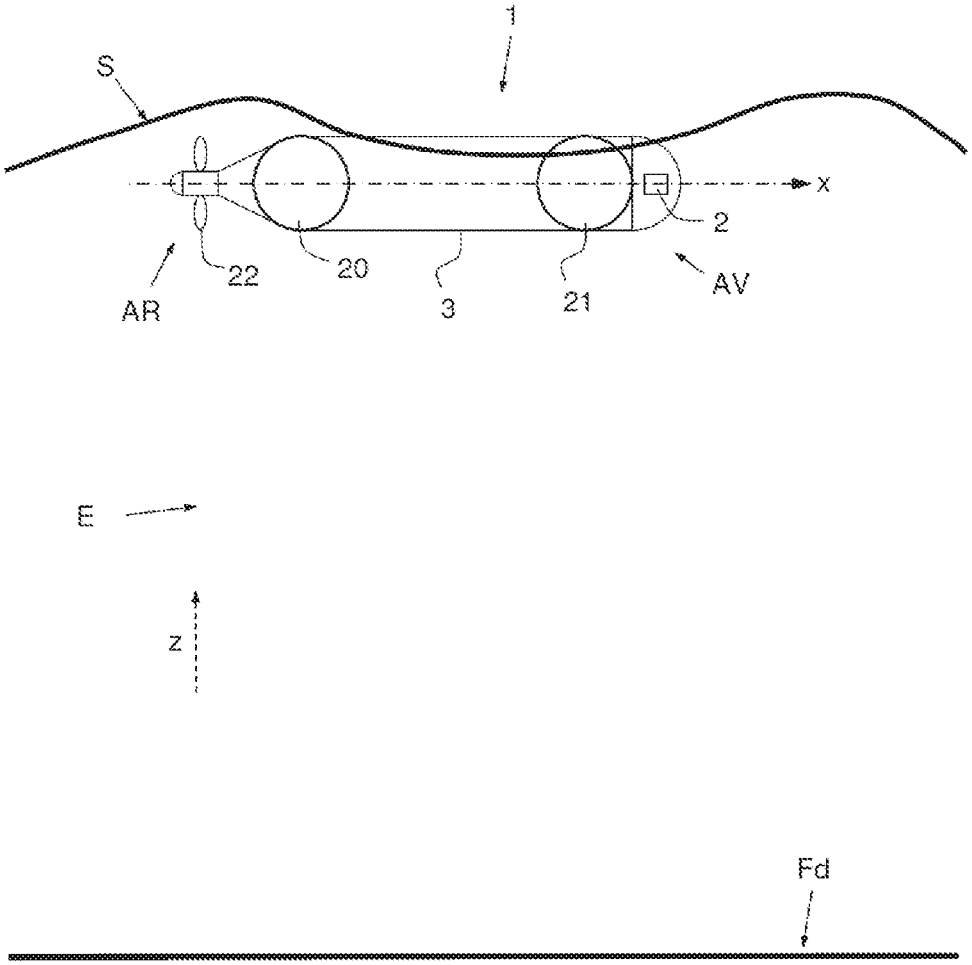
FIGS. 1*a*, 1*b* and 1*c* depict various situations of an underwater device during implementation of the method according to the invention, FIG. 2 schematically depicts one example of means for adjusting the buoyancy of a marine device according to the invention.

FIG. 1*a* depicts an underwater vehicle 1 initially exhibiting positive buoyancy. The underwater vehicle 1 in its initial situation depicted in FIG. 1*a* floats on the surface of the water S. As a variant, the underwater vehicle 1 initially has negative buoyancy so as to be kept against the seabed Fd.

Typically, the positive initial buoyancy of the vehicle is of the order of 5% of its weight. The purpose of the method is to give the underwater vehicle a final buoyancy that is as close as possible to 0 while still remaining positive. A setpoint buoyancy of between 0.05% and 0.01% of the weight of the vehicle is typically the goal to be achieved. For a vehicle weighing 1000 kg, that amounts to the need to balance the vehicle with a precision of within 100 g. When the underwater vehicle has very low positive buoyancy, it is able to resurface in the event of a breakdown in its propulsion means, and its energy consumption for diving toward the seabed is minimal. The fact that the setpoint buoyancy is positive gives a margin of buoyancy that makes it possible to ensure that the final buoyancy of the underwater vehicle at the end of the implementation of the method will be positive.

Figure 1B:
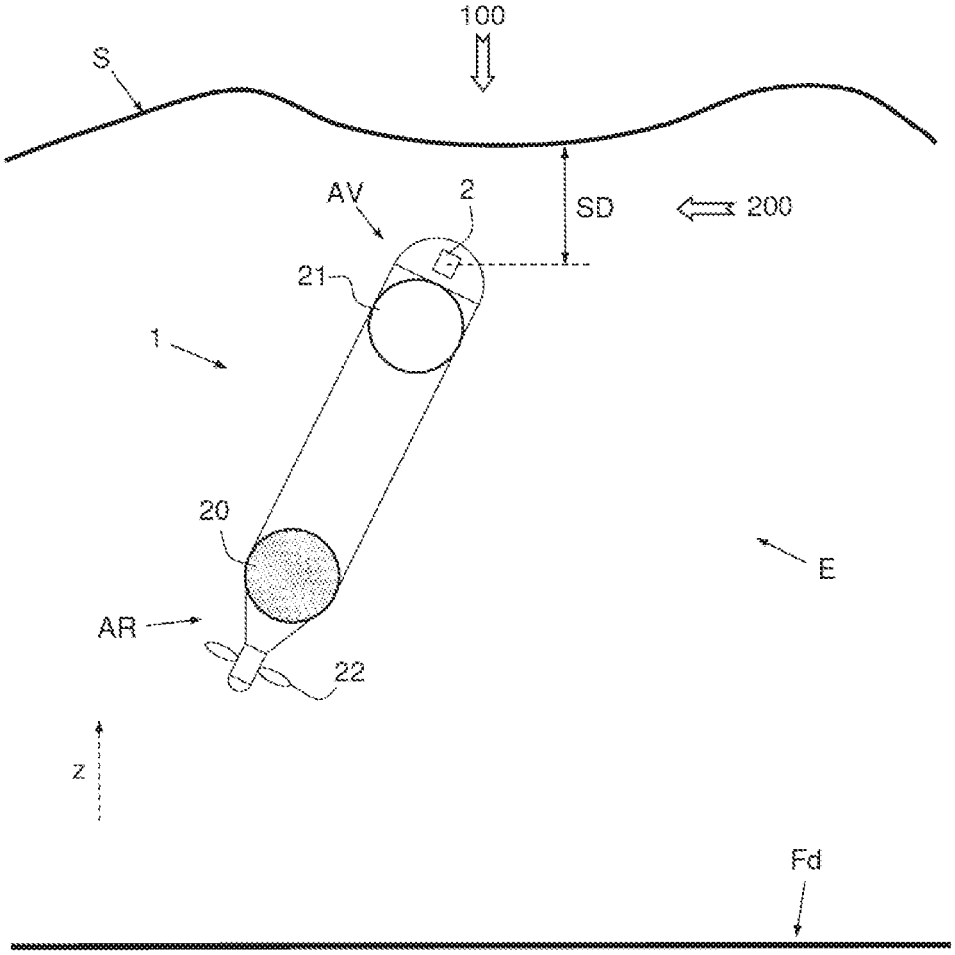
Figure 1C:
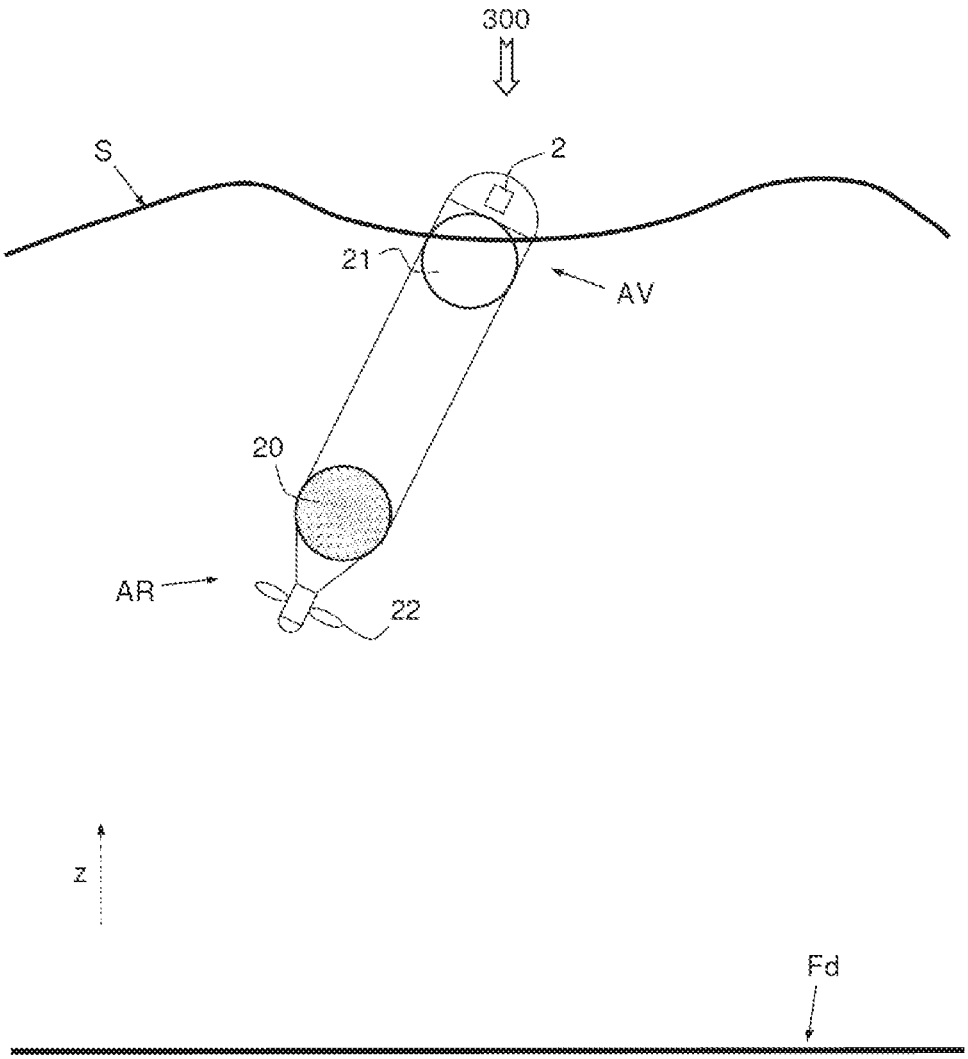

The method comprises the steps depicted in FIGS. 1*a* to 1*c*.

This method comprises a first step 100 of modifying the density of the vehicle 1 so that it moves away from the initial surface S toward the other surface delimiting the volume of liquid. Thus, the vehicle moves in a vertical direction. The variation in density of the vehicle causes the buoyancy of the vehicle to vary. In the example of FIGS. 1*a* to 1*c*, this step 100 is a step of increasing the density of the underwater vehicle 1 in such a way that the underwater vehicle 1 sinks, namely moves away from the surface of the water S or moves closer to the seabed Fd. If the underwater vehicle has negative initial buoyancy, this step is a step of decreasing the density of the underwater vehicle 1 so that the underwater vehicle 1 rises toward the surface of the water S, namely away from the seabed Fd.

The first step 100 of modifying the density is implemented until a second step 200.

During the first step 100, the pitch of the vehicle may vary under the effect of the variation in density, and this does not impact on the buoyancy regulating method according to the invention.

This second step 200 is a step of detecting the crossing, by the underwater vehicle 1, of a predetermined non-zero threshold SD on distance with respect to the initial surface S, along a vertical axis z. If the initial surface S is the surface of the water, the distance threshold SD is an immersion threshold or threshold on distance with respect to the surface of the water. If the initial surface S is the seabed, the distance threshold SD is an altitude threshold, namely a threshold on distance with respect to the seabed along the axis z.

The first step 100 is stopped as soon as it is detected 200 that the vehicle 1 has crossed the threshold SD.

The method further comprises a third step 300 of modifying the density of the underwater vehicle 1 until the buoyancy of the underwater vehicle 1 is substantially equal to the target buoyancy.

The density of the vehicle 1 advantageously varies in just one direction during the third step 300. In other words, the buoyancy of the vehicle varies only in one direction during the step 300.

When the underwater vehicle 1 crosses the distance threshold SD, it exhibits a known or determinable buoyancy. When the vehicle crosses the predetermined distance threshold SD it still has the same buoyancy, whatever its initial buoyancy, if the conditions of variation of buoyancy during the first step 100 are the same for the same initial longitudinal pitch. This buoyancy is used as reference. Once this reference has been obtained, it is possible to determine a variation in density that will make it possible to achieve the target buoyancy during step 300 whatever the initial buoyancy. All that is then needed is a one-time evaluation of this variation in density.

For example, for a vehicle of approximately 1000 kg that is weighted down using a pump that has a chosen delivery, and an immersion trip threshold at 1 m, will cross the threshold always with the same buoyancy. One example of buoyancy on the crossing of the threshold of −20N corresponds to around $-20/(1000\times10)=0.2\%$ of the weight of the vehicle for a Newtonian constant rounded up to 10 N $m^2$ $kg^{-2}$. If the target buoyancy is 0.05% of the weight of the vehicle then, once the threshold has been crossed, the vehicle needs to be lightened by $(0.05+0.2)/100\times1000=2.5$ kg.

The method according to the invention requires relative precision on the adjustment of the buoyancy of the vehicle, something which is easier to obtain than absolute precision on the buoyancy of the vehicle. It is independent of the initial buoyancy of the vehicle and therefore repeatable.

This method can be implemented at any time, namely on the launching of the vehicle or indeed during the course of a mission or when reconfiguring the underwater vehicle (adding or remove sensors for example).

This method can easily be automated because its steps are few in number and sequential, it is therefore readily adaptable to unmanned vehicles UUV and does not require the intervention of an external operator.

The method according to the invention is independent of the mass and/or the volume of the underwater vehicle 1. It allows the target buoyancy to be achieved even if one of these two parameters varies, for example in the event of a deliberate or unintentional addition or removal of components or particles, notably in the case of the loss of a blade from a bladed propulsion unit after its initial launch.

The method according to the invention is much quicker than a series of weighings carried out by an operator in water of a certain density, making it possible to calculate the amount of ballast to be added to or removed from the vehicle.

This solution requires only an immersion or pressure sensor to detect the crossing of the threshold. This type of sensor is simple and cost effective.

To sum up, the proposed solution is inexpensive, simple to implement and allows the underwater vehicle to be balanced reliably, repeatably and in a way that is readily automatable (simple algorithm simply requiring an immersion sensor).

In the example of FIGS. 1*a* to 1*c*, the initial buoyancy is positive, the target buoyancy is positive and less than the initial buoyancy and the buoyancy of the vehicle when it crosses the threshold SD is negative. In other words, the vehicle is given a slight tendency to sink for a short period of time and therefore leads away from the surface of the water S before becoming buoyant again. The buoyancy of the underwater vehicle increases during the third step 300 to a positive buoyancy; it therefore rises up to the surface S of the water where it floats during the third step 300. As a variant, the final buoyancy is negative or zero.

In this embodiment, the buoyancy varies in one direction during the step 100 and in the opposite direction during the step 300 but, as a variant, the variation in the density during these steps could be such that the buoyancy varies in the same direction during both of these two steps.

As a variant, the initial buoyancy is negative, the buoyancy on the crossing of the threshold is positive and the target buoyancy is positive. As a variant, the final buoyancy is negative or zero.

Advantageously, the target buoyancy has an absolute value that is lower than the absolute value of the initial buoyancy.

For example, the target buoyancy is negative and has an absolute value lower than the absolute value of the negative initial buoyancy and the buoyancy on the crossing of the threshold is positive. That makes it possible to limit the energy that the vehicle requires to subsequently resurface under the effect of its own propulsion. This method is more rapid than a continuous variation of the vehicle and avoids unwanted resurfacings of the vehicle. This method is also more reliable than a static weighing.

During steps 100 and 300, the density of the underwater vehicle 1 is varied by varying its mass for a constant volume of the underwater vehicle and/or by modifying its volume for a constant mass of the underwater vehicle.

The variation in density of the vehicle during step 300, namely the variation in mass or volume of the vehicle during the step 300 is dependent on the buoyancy of the vehicle when the crossing of the threshold is detected 20.

The variation in the density during the step 300 is dependent on the distance threshold SD and on the target buoyancy Fc.

Advantageously, the method is implemented in such a way that the vehicle 1 exhibits predetermined buoyancy on detection of the crossing of the threshold, namely at the end of the first step 100.

That makes it possible to improve the precision with which the final buoyancy of the underwater vehicle 1 is regulated and to simplify the method. All that is required is for the variation in mass or volume then needed to achieve the target buoyancy in step 300 to be determined once. In other words, the variation in mass or in volume that is needed in order to achieve the target buoyancy during step 300 is predetermined.

The variation in density or in mass or in volume during step 300 is predetermined. It is dependent on the buoyancy of the vehicle upon the detection of the crossing of the threshold.

This variation during step 300 is therefore dependent on the initial conditions and on the conditions in which step 100 is carried out. It is the same for the same initial conditions and the conditions in which step 100 is carried out.

The variation in density needed to achieve the target buoyancy during step 300 may be obtained beforehand iteratively or by trial and error. For example, the method according to the invention is implemented a number of times with predetermined initial conditions and predetermined conditions of variation of density during step 100 and, once the crossing of the threshold is detected and the step 100 is stopped, the volume (or the mass) of the vehicle is varied. During the various implementations of the method, the volume is varied by different amounts and the final buoyancy is compared each time to the target buoyancy. This comparison step may be performed by measuring a parameter representative of the final buoyancy and by comparing this value with the value that this parameter ought to exhibit for the target buoyancy. This is, for example, a distance, measured in the vertical direction, between the vehicle and a predetermined surface of the liquid. Alternatively, the variation in volume needed, in step 300, to obtain the target buoyancy may be determined by varying the volume of the vehicle little by little until the target buoyancy is achieved.

The buoyancy of the vehicle at the moment of detection of the crossing of the distance threshold SD or on the stopping of the first step is dependent on regulatable conditions of variations in the density of the vehicle during step 100 which have an influence on the buoyancy of the underwater vehicle 1 at the time of detection of the crossing of the threshold. For example, if the vehicle 1 has several reservoirs the density of which can be varied independently in order to vary the density of the vehicle, the choice of reservoir has an impact on the buoyancy of the vehicle at the time of the crossing of the threshold just as does the rate at which the mass or the volume of the vehicle is varied (namely the rate at which the mass or volume of each reservoir is varied). These parameters are predetermined so that the vehicle 1 exhibits a predetermined buoyancy at the time of detection of the crossing of the threshold, namely at the end of the first step 100.

As an alternative, mass or volume variations to be applied to the vehicle during step 300 in order to achieve the target buoyancy Fc or various target buoyancies may be determined before the implementation of the method for various values of these parameters and of the target buoyancy and stored in a table as explained above. The method advantageously comprises, prior to step 300, a step of determining the variation in mass or in volume to be applied to the vehicle during step 300 in order to achieve the target buoyancy Fc starting from the value of at least one parameter, for example by consulting a table.

The parameters may also comprise a density of the volume of the liquid. The variation in mass or in volume may be determined for several densities. The method may then comprise a step of determining a density of the liquid in which the vehicle is immersed, for example from a measurement of the salinity of the water which measurement is obtained from a salinity sensor 35. As an alternative, the density is predetermined.

Advantageously, at least one initial condition for implementation of step 100 that has an influence on the buoyancy of the underwater vehicle at the moment of detection of the threshold is predetermined, such as, for example, the initial predetermined initial longitudinal pitch of the underwater vehicle, for example zero or having some other value.

The method may then comprise, prior to step 100, a step of regulating the pitch of the vehicle so that the vehicle exhibits a predetermined longitudinal pitch, if the pitch of the vehicle is different from the predetermined longitudinal pitch.

As a variant, the variation in mass or in volume is determined independently of this initial condition.

Advantageously, during implementation of the method, the speed of the underwater vehicle along the vertical axis is brought about only by a variation in its buoyancy in a calm sea state.

Advantageously, the vehicle 1 has a substantially zero speed with respect to the liquid in which it is immersed, in a horizontal plane.

That makes it possible to avoid the disturbances generated by the hydrodynamic thrust on the buoyancy of the vehicle on the passing of the threshold and therefore on the final buoyancy of the vehicle.

Advantageously, the initial speed of the vehicle with respect to the liquid in which it is immersed is zero.

As can be seen in the figures, the underwater vehicle 1 may comprise a propulsion means 22 intended to propel the marine vehicle 1. Advantageously, the propulsion means 22 is switched off throughout the duration of the implementation of the buoyancy regulating method. As a variant, the vehicle has no propulsion means.

Figure 2:
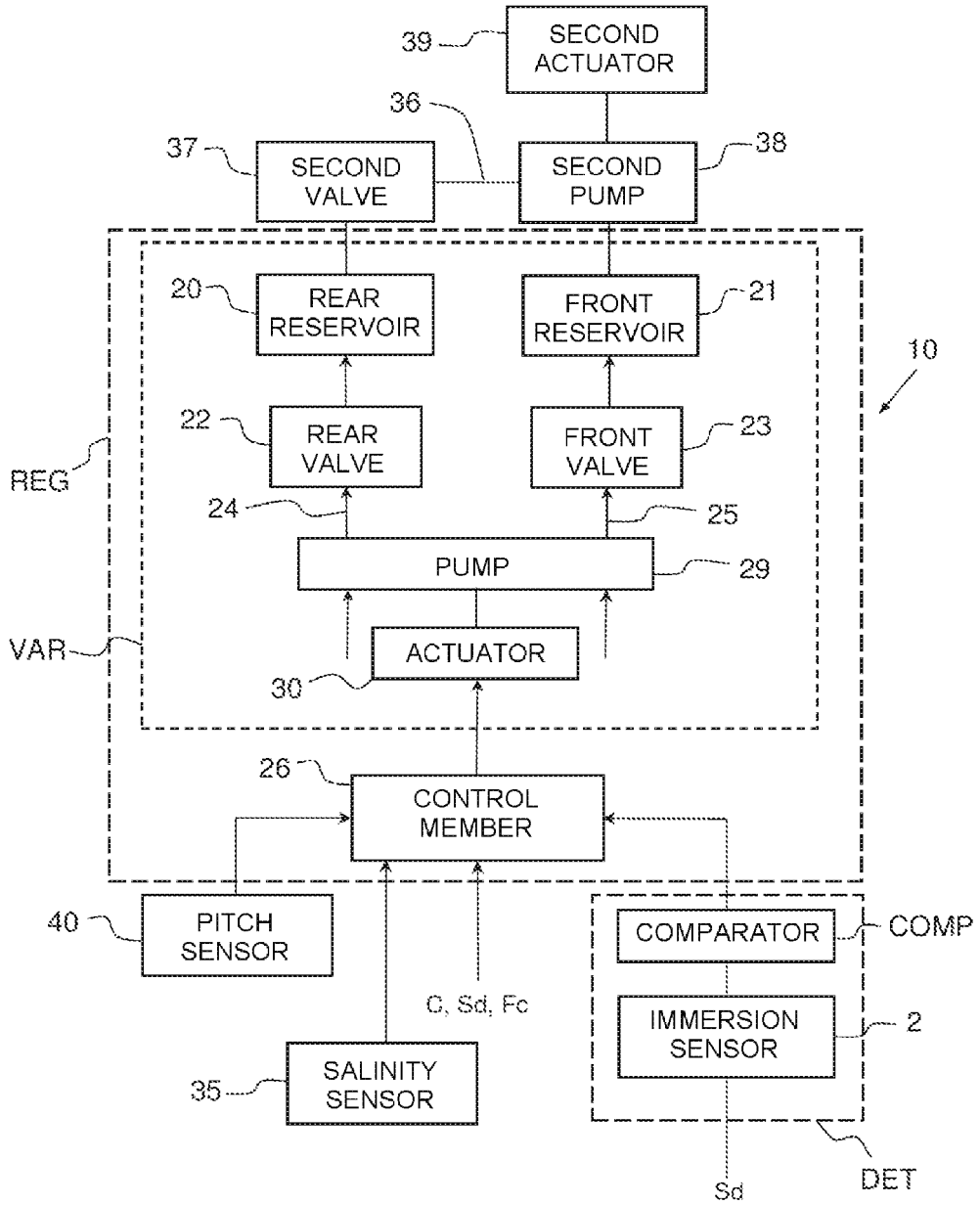

FIG. 2 depicts means 10 for regulating the buoyancy of the vehicle 1 according to the invention able to implement the method according to the invention. These means are advantageously configured to implement the steps of the method when a buoyancy regulating condition is satisfied.

The vehicle 1 comprises detection means DET for detecting the crossing of the distance threshold SD making it possible to verify whether the vehicle has crossed the distance threshold. These means comprise at least one sensor 2, also depicted in FIGS. 1*a* to 1*c*, able to measure a parameter representative of the distance separating the vehicle from the initial surface along the axis z. This sensor is, for example, an immersion or pressure sensor. The detection means DET also comprise a comparator COMP making it possible to verify whether a distance of the vehicle 1 with respect to the surface S, as determined from this measurement, is equal to the distance threshold SD. The sensor 2 is fixed with respect to the body 3 of the vehicle 1.

The underwater vehicle 1 comprises a device REG for regulating the buoyancy of the underwater vehicle 1 allowing the buoyancy of the underwater vehicle 1 to be regulated.

The regulating device REG comprises means VAR for varying the density of the vehicle 1 and a control member 26 allowing these means to be operated so as to implement the method according to the invention. Advantageously, the control member is configured to operate the means VAR to implement the method according to the invention.

The means VAR for varying the density comprise at least one variable-density reservoir 20 or 21, which means to say reservoir with variable mass and fixed volume (as in the example of FIGS. 1*a* to 1*c*) and/or at least one reservoir with a variable volume and fixed mass, and means allowing this mass or this volume to be varied, these means being controllable using the control member 26.

The reservoirs 20, 21 are able to communicate with the medium in which the underwater vehicle is immersed so that liquid in which the underwater vehicle 1 is immersed can circulate between these reservoirs and the marine environment so as to fill the reservoirs with or empty the reservoirs of this liquid. This medium is, for example, the marine environment but may be any other liquid. In the following part of the text, reference will be made to the marine environment, but the invention is of course applicable to any other liquid.

The reservoirs 20, 21 are able to communicate with the marine environment via respective hydraulic circuits 24, 25 that can be opened or closed by respective front AV and rear AR valves 22, 23, the circulation of the water from the marine environment toward the reservoirs 20, 21 (or vice versa) being brought about by a pump 29 actuated by an actuator 30, for example a motor. The actuator 30 and the front AV and rear AR valves are controlled by the control member 26 to cause the masses of the reservoirs 20 and 21 to vary by varying the volume of water contained in these reservoirs 20 and 21 (by discharging water contained in the reservoirs into the marine environment, or vice versa) during the steps 100 and 300. The control member 26 may also make it possible to control the actuator and the valves in order to cause the conditions of variation of the density (the pump delivery, the distribution of the variations in mass between the reservoirs) to vary. As a variant, these conditions are fixed.

In this example, with the mass of the reservoirs varying and the volume remaining fixed, the upthrust acting on the underwater vehicle is fixed during implementation of the method (if it is considered that the portion of the vehicle that is situated out of the water is negligible when the underwater vehicle is floating), whereas its weight varies.

After detection of the crossing of the distance threshold SD, the variation in weight (in Newtons) needed for the buoyancy of the underwater vehicle to reach the setpoint buoyancy Fc is constant and dependent on the immersion threshold SD and on the setpoint buoyancy Fc. For a setpoint buoyancy of 10 N and a buoyancy of the underwater vehicle 1 of −15 N on detection of the crossing of the threshold, the variation in weight that the underwater vehicle needs to undergo in order to achieve the setpoint buoyancy is 25 Newtons.

The mass of the reservoirs therefore needs to be varied by $Dm=DP/g=25/9.81=2.548$ kg, g being the acceleration due to gravity (9.81 $ms^{-2}$). That represents a variation in water volume $DV=Dm/d$ where d is the density of the liquid in which the underwater vehicle is immersed. In the case of seawater, d=1.025 kg/L. Therefore $DV=2.548/1.025=2.486$ L.

That means that 2.486 L of seawater needs to be removed from the reservoirs in order to lighten the vehicle in order to obtain the setpoint buoyancy.

In the nonlimiting embodiment of the figures, the reservoirs 20 and 21 are spaced apart along an axis x of the underwater vehicle 1 which is, in the nonlimiting example of the figures, a longitudinal axis along which the underwater vehicle extends longitudinally. The two reservoirs 20, 21 are then each placed near one of the ends of the underwater vehicle 1. The reservoir 21 is placed near the front end AV and the reservoir 20 near the rear end AR of the underwater vehicle. As a variant, the means for varying the buoyancy comprise a single reservoir or more than two reservoirs. The vehicle is intended to move mainly along the longitudinal axis in the direction from the rear end AR toward the front end AV.

As a variant or in addition, the means VAR for varying the density comprise at least one reservoir, referred to as an external reservoir, of variable volume arranged in such a way that a variation in the volume of the reservoir leads to a modification to the volume of the underwater vehicle 1. This reservoir communicates for example with an internal reservoir positioned inside the body of the underwater vehicle via a valve so as to allow a fluid to be made to pass from one of the reservoirs to the other or so as to block the passage of this fluid between the two reservoirs, a pump causing the fluid to circulate via the valve. An actuator, for example a motor, is provided to actuate the pump. The valve and the pump are operated by a control member that receives measurements from an immersion sensor making it possible to measure the immersion of the underwater vehicle and operating the valve in such a way as to vary the volume of the external reservoir so that the underwater vehicle exhibits a setpoint immersion received via the control member. This solution gives rise to fewer problems with corrosion and reliability than the previous solution at the expense of the underwater vehicle. Two reservoirs may be provided, one at each longitudinal end of the underwater vehicle.

In that case, the weight of the underwater vehicle is constant but the upthrust varies during implementation of the method. For a setpoint buoyancy of 10 N and a buoyancy of the underwater vehicle of −15 N at the start of step 200, the variation in upthrust DA that the underwater vehicle needs to experience in order to achieve the setpoint buoyancy is 25 Newtons. The volume of the underwater vehicle therefore needs to be increased by DV=DA/(g*d)=25/(9.81×1.025)=2.486 L.

The control member 26 triggers implementation of the method when the condition for regulating the buoyancy is satisfied. The condition for regulating the buoyancy may be satisfied when the control member receives an instruction C to regulate the buoyancy. As an alternative, the method comprises a verification step consisting in verifying whether the condition for regulating the buoyancy has been satisfied, this step being implemented by the control member. This step may be carried out on the basis of a measurement of the density of the liquid. The instruction to regulate the buoyancy is for example satisfied when the density of the water drops below or increases above a certain threshold or, for example, when a variation in the volume or in the mass of the underwater vehicle exceeds a certain threshold (for example when the hull of the underwater vehicle is plagued with shellfish or when installing a new piece of equipment).

Advantageously, during step 100, the density of a predetermined single one, of the two reservoirs 20 and 21, is modified. That makes it possible to obtain a quicker dive of the underwater vehicle 1 and therefore the crossing of the immersion threshold occurs after the addition of a smaller quantity of water than if both reservoirs were filled simultaneously. The method is therefore faster (the quantity of water to be removed from the reservoirs during step 200 is also lower) and requires less energy.

In the embodiment in which the volume of the underwater vehicle 1 is modified during step 100, the volume of just one of the two variable-volume reservoirs situated at one of the ends of the underwater vehicle can be modified so as to vary the volume of the underwater vehicle near this end only.

Advantageously, the reservoir of which the density is varied during step 100 is the reservoir 20 situated near one end (in this case the rear end AR) which is the opposite end to another longitudinal end AV of the vehicle near which end are positioned a sensor or an emitter of radioelectric waves belonging to the vehicle and intended to be used when this sensor or this detector is out of the water so that the vehicle can communicate with a sensor/detector external to the vehicle. That makes it possible to maintain communication between the vehicle and the outside for longer when the vehicle is about to dive.

As a variant, during step 100, the density of the reservoirs is modified in a predetermined order of the reservoirs. For example, the reservoir 21 is filled first of all and then the reservoir 20 when the reservoir 21 is full.

The invention also relates to a balancing method comprising the buoyancy regulating method described hereinabove and a step of regulating the longitudinal pitch so that, at the end of the method, the vehicle exhibits a setpoint longitudinal pitch.

To this end, the underwater vehicle 1 advantageously comprises means for regulating the longitudinal pitch of the body 11 of the underwater vehicle 10.

These means for regulating the longitudinal pitch of the body 11 comprise means for varying the longitudinal pitch of the body of the underwater vehicle comprising, in the nonlimiting example of FIG. 2, the two reservoirs 20, 21 spaced apart along the longitudinal axis x and positioned respectively near the rear end AR and near the front end AV of the body 11. The means for varying the longitudinal pitch of the body 10 comprise a hydraulic circuit 36 via which the reservoirs 21 communicate with one another so that the passage of a fluid from one to the other is possible via a valve 37 that is able to close the hydraulic circuit 36 or open it in order to allow or disallow this fluidic communication. A second pump 38 allows the liquid to be circulated between the two reservoirs via the valve 37, and an associated second actuator 39 for actuating the pump 38.

As a variant, the one same pump can be used for varying the longitudinal pitch and the buoyancy. A directional control valve or one or more additional valves are then provided to connect the pump to one of the two hydraulic circuits. The directional control valve or each valve is operated by means of the control member.

The means for regulating the longitudinal pitch also comprise a control member allowing the means for varying the longitudinal pitch to be operated according to a setpoint longitudinal pitch and according to measurements from a pitch sensor 40 that allows the longitudinal pitch of the underwater vehicle to be measured, for example comprising immersion sensors positioned at the respective two longitudinal ends of the underwater vehicle or a gravity sensor measuring the verticality of the underwater vehicle or an inertial unit. This control member is the control member 26 for the buoyancy regulating means in FIG. 2, but may be another control member.

Regulating the buoyancy and the longitudinal pitch using the same reservoirs as depicted in the figure means that these means can be shared, thereby limiting the volume devoted to these adjustments and the number of elements dedicated to these adjustments.

The means for regulating the longitudinal pitch are advantageously configured so that the step of regulating the longitudinal pitch of the underwater vehicle consists in transferring water (or other liquid) from a reservoir positioned near one end of the underwater vehicle, for example the reservoir 21, toward the other reservoir located near the other longitudinal end of the underwater vehicle, for example the reservoir 20. Thus, the buoyancy is not modified and only the pitch varies.

Other types of controllable internal means may be used to vary the pitch of the underwater vehicle, such as masses capable of translational movement along the axis x, an example of which is described in document GB 2 335 888, although that system requires an additional and dedicated actuator.

As an alternative, the reservoirs 20, 21 are replaced by variable-volume reservoirs as described above. As an alternative, the vehicle comprises both types of reservoir.

Each control member and the comparator may each comprise one or more dedicated electronic circuits or a general purpose circuit. Each electronic circuit may comprise a reprogrammable calculation engine (a processor or a microcontroller for example) and/or a computer executing a program comprising a sequence of instructions and/or a dedicated calculation engine (for example a collection of logic gates such as an FPGA a DSP or a ASIC, or any other hardware module).

The invention claimed is:

1. A method for regulating the buoyancy of an underwater vehicle in such a way that it exhibits substantially a predetermined target buoyancy Fc when it is immersed in a volume of liquid delimited by a first surface and a second surface, along a vertical axis (z), the method comprising:

starting from an initial buoyancy of the vehicle that keeps the vehicle at the level of the first surface (S), modifying the density of the vehicle so that it moves closer to the second surface as far as a crossing, by the vehicle, of a predetermined non-zero threshold (SD) on distance with respect to the first surface (S), along the vertical axis, being detected, modifying the density of the vehicle so that the vehicle moves closer to the second surface being implemented in such a way that the vehicle exhibits a predetermined buoyancy upon the detection of the crossing of the threshold, then modifying the density of the vehicle until the vehicle exhibits substantially the target buoyancy, the variation in density during modifying the density of the vehicle until the vehicle exhibits substantially the target buoyancy being predetermined, the target buoyancy having the same sign as the initial buoyancy and an absolute value lower than the absolute value of the initial buoyancy.

2. The method as claimed in claim 1, wherein, during the implementation of the method, the vehicle moves, along the vertical axis, only under the effect of a variation in its buoyancy.

3. The method as claimed in claim 1, wherein the first surface is the surface of the liquid and the initial buoyancy is positive, modifying the density of the vehicle so that the vehicle moves closer to the second surface corresponding to increasing the density of the vehicle, the distance threshold being an immersion threshold.

4. The method as claimed in claim 1, wherein the first surface is a bottom of the volume of liquid, the initial buoyancy is negative, modifying the density being corresponding to reducing the density, the distance threshold being a threshold on altitude with respect to the first surface.

5. The method as claimed in claim 1, wherein during the modifying the density of the vehicle so that the vehicle moves closer to the second surface and during modifying the density of the vehicle until the vehicle exhibits substantially the target buoyancy, the mass of the vehicle is varied for a constant volume of the underwater vehicle, and/or the volume of the marine vehicle is varied for a constant mass for a constant mass of the underwater vehicle.

6. The method as claimed claim 1, wherein the vehicle comprises a first variable-density reservoir, the variation in density of which causes the density of the vehicle to vary, this being positioned near a first longitudinal end of the vehicle, and a second variable-density reservoir the variation in density of which causes the density of the vehicle to vary and which is positioned near a second longitudinal end of the vehicle, wherein, during the modifying the density of the vehicle so that the vehicle moves closer to the second surface, the density of a predetermined single one, of the first reservoir and the second reservoir, is varied.

7. A balancing method comprising the method for regulating the buoyancy as claimed in claim 1, followed by regulating the longitudinal pitch of the vehicle.

8. A device for regulating the buoyancy of an underwater vehicle comprising means of varying the buoyancy allowing the density of the underwater vehicle to be varied, and at least one sensor making it possible to detect the crossing, by the vehicle, of a predetermined non-zero threshold on distance with respect to a first surface delimiting, in a vertical direction, the volume of a liquid in which the vehicle is immersed, the buoyancy regulating device being configured to implement a method comprising, when a buoyancy regulating condition is satisfied:

starting from an initial buoyancy that keeps the vehicle at the level of the first surface; modifying the density of the vehicle via the buoyancy varying means so that the vehicle moves closer to a second surface delimiting the volume of liquid in the vertical direction as far as a crossing by the vehicle of the distance threshold being detected by the sensor, modifying the density of the vehicle so that the vehicle moves closer to the second surface being implemented in such a way that the vehicle has a predetermined buoyancy upon the detection of the crossing of the threshold, then a modifying the density of the vehicle, using the buoyancy varying means, until the vehicle exhibits substantially the target buoyancy, the variation in density during the modifying the density of the vehicle until the vehicle exhibits substantially the target buoyancy being predetermined, the target buoyancy having the same sign as the initial buoyancy and an absolute value lower than the absolute value of the initial buoyancy.

9. An underwater vehicle comprising the device for regulating the buoyancy as claimed in claim 8.

* * * * *